US006653543B2

(12) United States Patent
Kulas

(10) Patent No.: US 6,653,543 B2
(45) Date of Patent: Nov. 25, 2003

(54) MUSICAL INSTRUMENT TUNER WITH CONFIGURABLE DISPLAY

(76) Inventor: Charles J. Kulas, 244 Texas St., San Francisco, CA (US) 94107

( * ) Notice: Subject to any disclaimer, the term of this patent is extended or adjusted under 35 U.S.C. 154(b) by 0 days.

(21) Appl. No.: 10/151,627

(22) Filed: May 16, 2002

(65) Prior Publication Data

US 2003/0169377 A1 Sep. 11, 2003

Related U.S. Application Data

(60) Provisional application No. 60/362,853, filed on Mar. 7, 2002.

(51) Int. Cl.[7] ..... G10G 7/00
(52) U.S. Cl. ..... 84/454
(58) Field of Search ..... 84/454–460

(56) References Cited

U.S. PATENT DOCUMENTS

| | | | | | |
|---|---|---|---|---|---|
| 4,365,537 | A | * | 12/1982 | Pogoda | 84/454 |
| 5,214,231 | A | * | 5/1993 | Ernst et al. | 84/652 |
| 5,396,827 | A | * | 3/1995 | Miller et al. | 84/454 |
| 5,408,914 | A | * | 4/1995 | Breitweiser et al. | 84/477 R |
| 5,549,028 | A | * | 8/1996 | Steinberger | 84/454 |
| 5,777,248 | A | * | 7/1998 | Campbell | 84/454 |
| 6,066,790 | A | * | 5/2000 | Freeland et al. | 84/454 |
| 6,291,755 | B1 | * | 9/2001 | Hine et al. | 84/454 |

FOREIGN PATENT DOCUMENTS

| | | |
|---|---|---|
| JP | 60-41997 | 3/1985 |
| JP | 60-41998 | 3/1985 |
| JP | 60-68596 | 5/1985 |
| JP | 60-68597 | 5/1985 |
| JP | 60-74194 | 5/1985 |
| JP | 63-198095 | 12/1988 |
| JP | 4-17989 | 4/1992 |
| JP | 4-17990 | 4/1992 |

* cited by examiner

*Primary Examiner*—Jeffrey Donels
(74) *Attorney, Agent, or Firm*—Charles J. Kulas

(57) ABSTRACT

A musical instrument tuner includes a display screen. A user can select predetermined configurations such as for guitar, bass guitar, violin, cello, etc. Popular detuned settings for guitars, such as "drop-D," one half-step down, etc. can be provided as selectable presets with the display configuration changing to provide appropriate indicators. Bass guitars or other instruments that come in models having different numbers of strings can easily be accommodated with presets or through user customization. A user can also create a customized tuner with arbitrary note detection so that any instrument or user preference can be configured after the point of sale with a single manufactured device. In one embodiment, the tuner mounts adjacent to an instrument, such as a guitar, by using a standard ¼" plug. The tuner has a display screen that pivots to permit viewing on different types of guitars. A model is disclosed that is suitable for both left and right handed guitar players. The instrument-mounted tuner can be configured to accept signals from other devices and to provide auxiliary information to the musician. For example, the tuner can display chord charts, lyrics, song titles in a list of songs to be played at a performance, etc. The tuner can work in cooperation with guitar effects devices to indicate what effects are being applied to the tone, provide a visual metronome indication, etc. In another embodiment, the device performs analog-to-digital (A/D) conversion of an input instrument signal. The digital signal is provided to an external device.

25 Claims, 7 Drawing Sheets

MUSICAL INSTRUMENT TUNER WITH CONFIGURABLE DISPLAY

CLAIM OF PRIORITY

This invention claims priority from U.S. Provisional Patent Application Ser. No. 60/362,853 filed on Mar. 7, 2002.

BACKGROUND OF THE INVENTION

Musical instrument tuners use several types of indicators to show a user whether a note is on-pitch or off-pitch. Originally, mechanical electromagnetic meters were used. These have been supplemented with, or replaced by, light-emitting diodes (LEDs) and liquid crystal display (LCD) type of indicators.

A typical tuner is designed so that it can be used with many different instruments, voices, etc. Since different instruments, musicians, technicians, engineers, etc., have different needs for tuning instruments, and measuring pitch, a tuner usually is able to measure and indicate all audio frequencies across the usable spectrum. By using a meter (mechanical or LCD), and by indicating the nearest note in a chromatic scale, or by showing a frequency number on a display, the tuner can be used to tune to almost any audible frequency.

While this versatility ensures that one model of tuner can be used for many different purposes, some users desire a more customized tuner with a display better suited for their particular needs. For example, guitar players typically only need to tune to six different notes corresponding to the strings of the guitar. In the case of a user who wants a tuner strictly for tuning a guitar, the versatile model of tuner has some deficiencies. Because the versatile tuner indicates all frequencies it must be capable of presenting a lot of information and is often difficult to read. This is especially true in low-light conditions, or where the user is more than a short distance away from the tuner's indicators.

Some manufacturers make tuner models customized specifically for a guitar. The guitar tuners typically use dedicated LEDs, one for each string on the guitar. This gives the user a good "coarse" indication of what string is being played. A "fine" indicator such as an LCD meter, LED meter bar, mechanical meter, etc., then indicates the degree of off-pitch of the string. By using dedicated LEDs, one for each string, reading the tuner indicators is made much easier. Even where an LCD display is used, the tuner uses preset types of display indication and programming that is designed by the manufacturer. This is true of a generalized tuner designed to handle any type of tuning application, and of a customized tuner that is especially suited for one type of instrument.

A drawback with the prior art tuners is that they are not easily adaptable for uses other those initially intended by the manufacturer. For example, a guitar tuner may not be suitable for a bass guitar, cello, piano, or other instruments. Also, since musicians often use non-standard tunings, and since instrument manufacturers provide instruments with different numbers of strings, a specific tuner may not be well-suited for different tunings of the instrument for which it was designed. For example, guitars can have one or more strings tuned to different settings other than the standard EADGBE notes. Other instruments such as bass guitars, banjoes, sitars, etc., may use more or less strings and the strings can have different tunings. Although some customized tuners allow modifications to the tuner settings, such modifications can be confusing and require work to interpret the display. This detracts from efficient operation of the tuner.

SUMMARY OF THE INVENTION

The present invention provides a musical instrument tuner with configurable indicators. In a preferred embodiment, the tuner includes a display screen. A user can select predetermined configurations such as for guitar, bass guitar, violin, cello, etc. Popular detuned settings for guitars, such as "drop-D," one half-step down, etc. can be provided as selectable presets with the display configuration changing to provide appropriate indicators. Bass guitars or other instruments that come in models having different numbers of strings can easily be accommodated with presets or user customization. A user can also create a customized tuner with arbitrary note detection so that any instrument or user preference can be configured after the point of sale with a single manufactured device.

In a preferred embodiment the invention displays fine and coarse tuning indicators on the display screen. The coarse tuning indicator can be a letter indication of the closest filtered note, or color can be used. A fine tuning indicator shows the amount off-pitch from the closest filtered note. The coarse and fine tuning indicators can be alternately displayed, or they can be concurrently displayed adjacent to, or overlapping with, each other. Other types of displays are possible and can be provided as defaults or by user selection.

Other features of different embodiments include the ability for a user to select coarse tune notes, indicator arrangement and behavior and configuration of the tuner via a network wired or wireless protocol using a personal computer.

In one embodiment, the tuner mounts adjacent to an instrument, such as a guitar, by using a standard ¼" plug. The tuner has a display screen that pivots to permit viewing on different types of guitars. A model is disclosed that is suitable for both left and right handed guitar players. The instrument-mounted tuner can be configured to accept signals from other devices and to provide auxiliary information to the musician. For example, the tuner can display chord charts, lyrics, song titles in a list of songs to be played at a performance, etc. The tuner can work in cooperation with guitar effects devices to indicate what effects are being applied to the tone, provide a visual metronome indication, etc.

In another embodiment, the device performs analog-to-digital (A/D) conversion of an input instrument signal. The digital signal is provided to an external device.

In another embodiment the invention provides a musical instrument tuner comprising a display screen; and at least one configuration control for configuring the display screen in first and second display configurations.

In another embodiment the invention provides a musical instrument tuner comprising a body for housing an indicator that indicates a degree of tuning of a musical instrument; a plug integral with the tuner for mounting the tuner adjacent to the musical instrument and for receiving an output from the musical instrument; and first and second jacks for receiving plugs so that the tuner is operable symmetrically in a left or right hand configuration.

In another embodiment the invention provides an instrument display comprising a display screen; mounting means for mounting the display screen proximate to a musical instrument; a control system for receiving signals; and a display system for deriving text information from the received signals and for displaying the visual information on the display screen.

BRIEF DESCRIPTION OF THE DRAWINGS

FIG. 1 C is a back view of a preferred embodiment of the invention;

DETAILED DESCRIPTION OF A PREFERRED EMBODIMENT

Figure 1C:
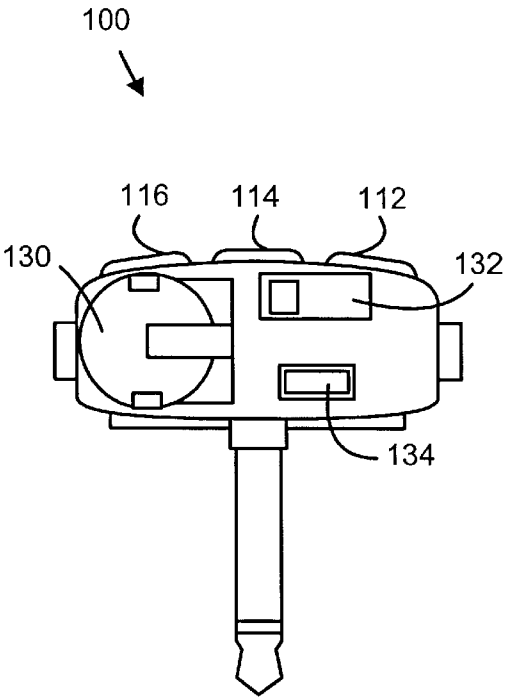
FIG. 1A is a front view of a preferred embodiment of the invention.
FIG. 1 B is a right side view of a preferred embodiment of the invention.
Figure 1B:
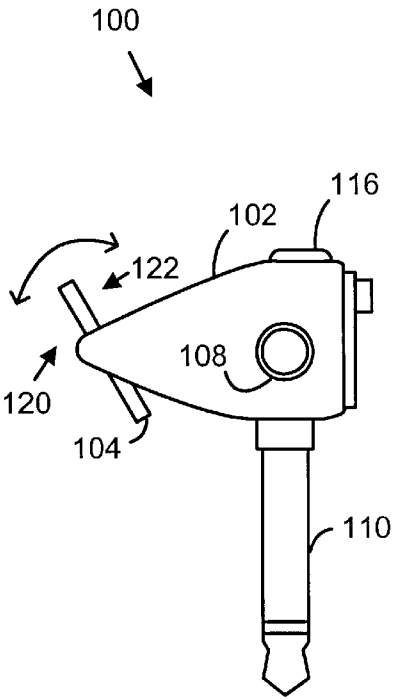
Figure 1A:
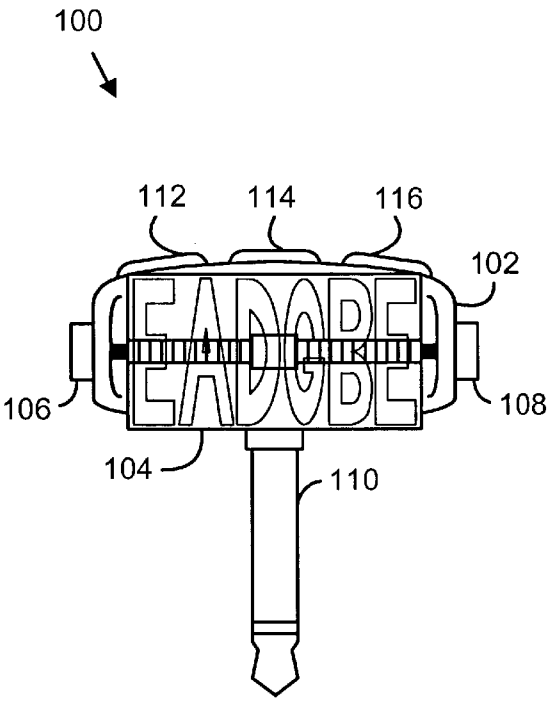

FIGS. 1A–C are front, side and back views of a preferred embodiment of the invention. FIGS. 1A–C show the preferred embodiment at approximately full scale.

In FIG. 1A, tuner 100 includes body 102, display 104, left jack 106, right jack 108 and plug 110. Buttons 112, 114 and 116 are user controls for configuring and operating the tuner and are discussed in more detail, below. The plug is integral with the body and is used to both mount the tuner to an instrument, such as a guitar, and to receive a signal output from the instrument. In typical operation either the left or right jack is used to receive a plug at one end of a wire or cable for connecting a signal output from the tuner to another device such as an amplifier, effects unit, recording device, etc.

Display 104 is preferably a color display screen with about 110×80 picture elements (pixels) of resolution. Different display technologies can be used such as thin-film transistor (TFT), liquid crystal display (LCD), light-emitting diode (LED), organic LED (OLED), light-emitting polymer (LEP), electroluminescent, plasma, etc. Any type of display can be used including displays of different resolutions, monochrome displays or displays with a limited number of colors, etc. Displays need not use discrete pixels but can be based on scanning electron beams and other approaches. The display need not be rectangular or even flat but can be any shape and size. Future display technologies can include three dimensional projections, virtual displays, etc.

A preferred embodiment allows display 104 to pivot vertically while the tuner body remains in a fixed mounted position relative to an instrument as shown in FIG. 1B.

FIG. 1B, shows the tuner of FIG. 1A in a side view. Use of the same reference numbers in different FIGS. generally denotes the same item or element. In FIG. 1B, display 104 is shown tilted slightly "downward" or towards plug 110. A preferred embodiment of the invention only allows the display to tilt vertically. However, other embodiments can allow positioning of the display in any orientation.

A contemplated embodiment of the invention uses a reflective type of display on surface 120 and an emissive type of display on surface 122. The device can detect which surface is outward-facing (e.g., surface 120 in the example of FIG. 1B) and will deactivate the inward-facing (non-viewable) side. By providing a user with a choice of both (1) reflective and (2) light emitting emissive displays both high and low light conditions (e.g., sunlight and indoor dim lighting, respectively) can be accommodated.

FIG. 1C shows a back view of tuner 100. In FIG. 1C, battery 130, on/off/mode switch 132 and connector 134 are shown.

Figure 2B:
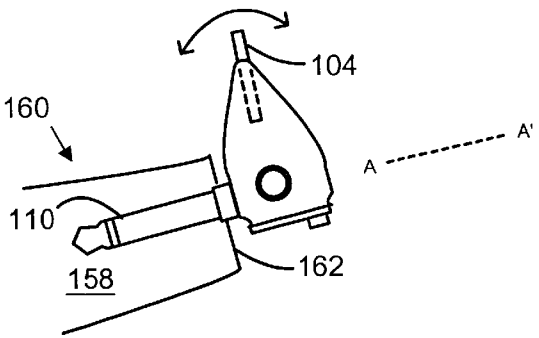
FIG. 2B is a side view of the device in an edge-mounted position.
Figure 2C:
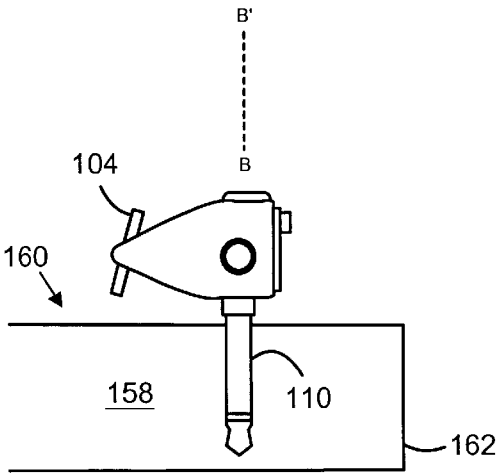
FIG. 2C is a side view of the device in a top-mounted position.
Figure 2A:
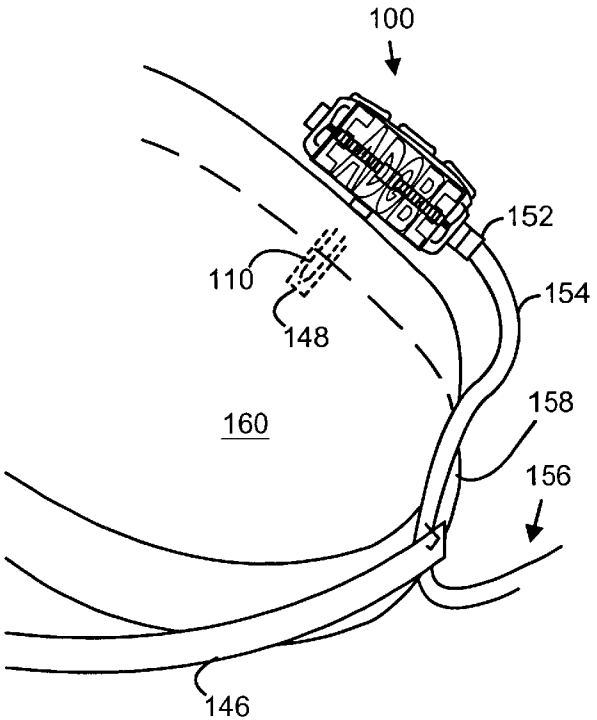
FIG. 2A is a front view of the device in an edge-mounted position.

FIG. 2A shows tuner 100 mounted to edge 158 of a guitar. Such mounting, and other aspects of a preferred embodiment of the present invention, is discussed in detail in co-pending U.S. patent application Ser. No. 09/840,689 filed on Apr. 23, 2001 entitled "MUSICAL INSTRUMENT TUNER INTEGRAL WITH A CONNECTOR." Such mounting is accomplished by inserting plug 110 into jack 148. Jack 148 is preferably built-in to the guitar body. Plug 110 and jack 148 are not normally visible from the viewpoint illustrated in FIG. 2A and are shown by dashed lines. Plug 110 is electrically coupled to circuitry within the guitar (not shown) to receive a signal output from the guitar.

The guitar body includes edge 158, which runs along the periphery of the guitar, and guitar top surface 160. The tuner outputs a signal through plug 152 connected to cable 154, as is known in the art. Cable 154 should preferably be routed through strap 148 so that the cable serves to fix the tuner from rotation within jack 148 while being used. Cable end 156 continues on to connect the output of the tuner with an external device such as an amplifier, effect, recording device, etc.

Note that FIG. 2A shows the tuner mounted to a right-hand guitar where the neck of the guitar is held in the left hand. It should be apparent that since the tuner is symmetrical and has jacks on either side, that the tuner can be operated in an identical manner with a right-hand guitar where the use would be a mirror image of FIG. 2A. Although the preferred embodiment uses the symmetrical arrangement that allows substantially equal use with both left and right hand guitars, other embodiments can be specially adapted for either left or right hand guitars.

FIG. 2B shows the tuner in an edge-mounted position. In FIG. 2B, tuner 100 has its display 104 at approximately a right angle to line A–A' which is an extension of the line defined by the tuner's plug 110. The tuner is mounted onto edge 158 so that the display screen substantially extends beyond guitar top surface 160.

Figure 3B:
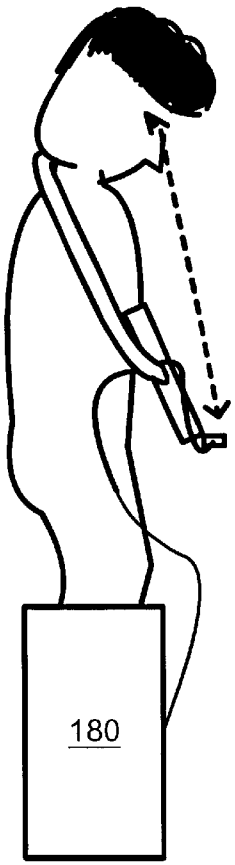
FIG. 3B is a side view of the device in an edge-mounted position.
Figure 3A:
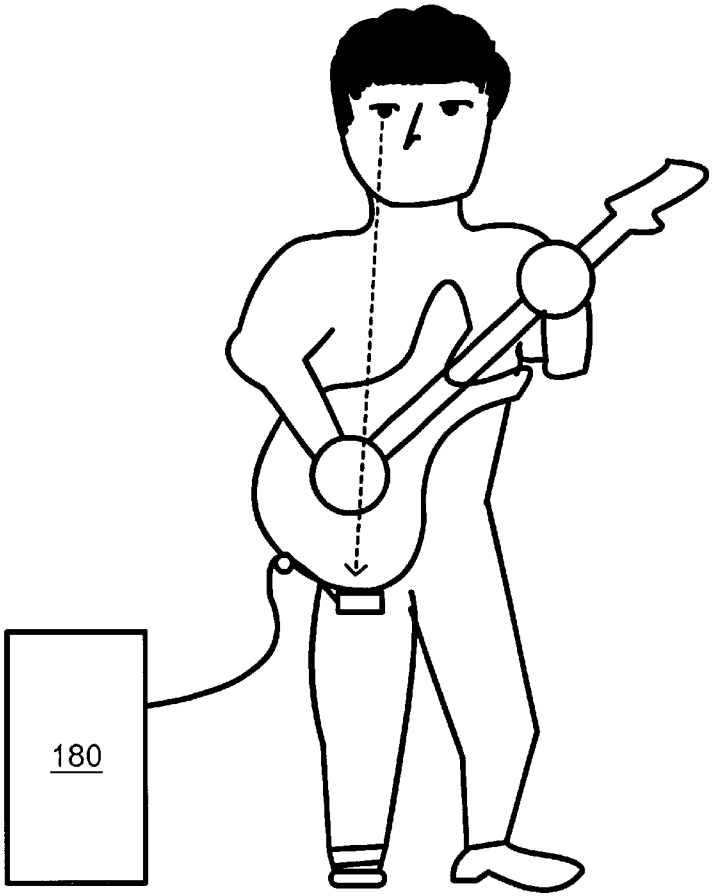
FIG. 3A is a front view of the device in an edge-mounted position.

FIGS. 3A and 3B illustrate a musician's view of the tuner in an edge-mounted position with device 180 receiving a signal output from the tuner.

Figure 3D:
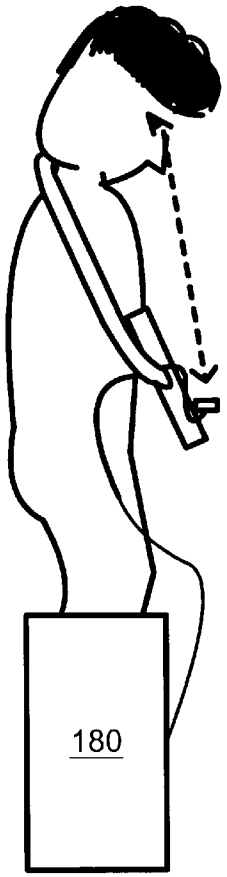
FIG. 3D is a side view of the device in a top-mounted position.
Figure 3C:
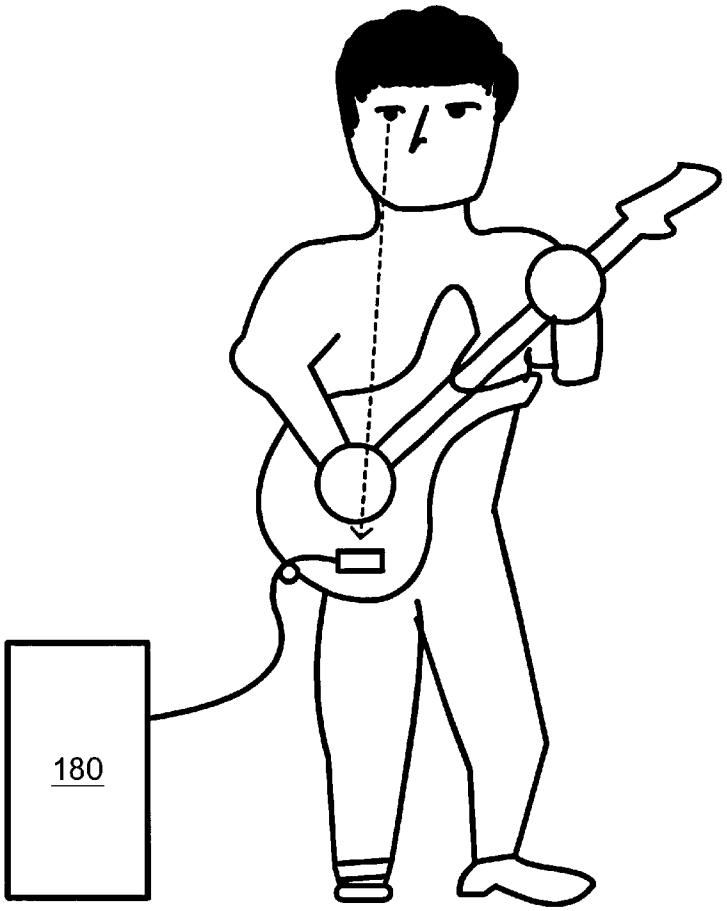
FIG. 3C is a front view of the device in a top-mounted position.

FIG. 2C shows the tuner in a top-mounted position. In FIG. 2C, tuner 100 has its display 104 at approximately a parallel angle to line B–B', again following the extension of a line defined by the tuner's plug 110. FIGS. 3C and 3D illustrate the top-mounted position of the tuner with respect to a musician's viewpoint. Naturally, the display angle of the tuner is adjusted as desired by the musician, preferably for easiest visibility. The display is movably coupled to the tuner body at the approximate midpoints of the left and right edges of the display screen so that the display can easily be positioned vertically by hand. There is enough friction in the coupling so that the display will remain in a set position until again moved by hand.

Figure 4B:
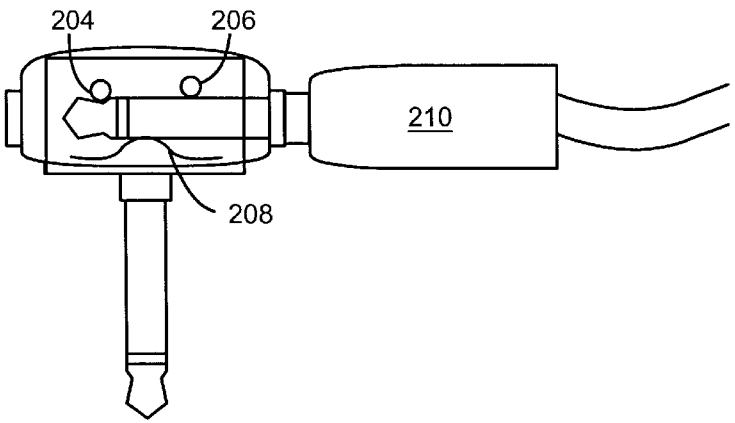
FIG. 4B shows a symmetrical device with a plug inserted into the right side.
Figure 4A:
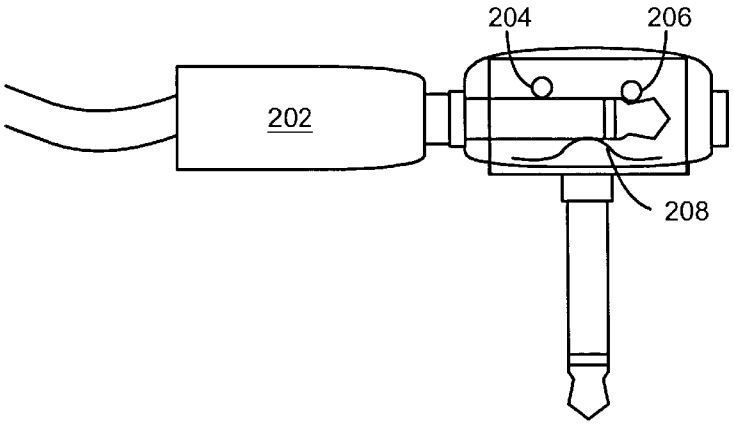
FIG. 4A shows a symmetrical device with a plug inserted into the left side.

FIGS. 4A and 4B illustrate the tuner's electrical coupling to a plug in left and right hand positions.

FIG. 4A shows a front view of the tuner with plug 202 inserted in a left-hand position in the left side of the tuner. Contacts 204 and 206 are in tensioned contact with the conductive tip and sleeve, respectively, of the plug. Contact 208 serves to press the plug against the contacts to maintain a good electrical connection and to keep the plug inserted into the jack. As is known in the art, the signal output from the tuner can be applied to the plug's tip and sleeve to provide an electrical signal to another device.

FIG. 4B shows the same tuner with plug 210 inserted in a right-hand position in the right side of the tuner. The same contacts 204 and 206 are used, however, their point of contact with the plug is now to the sleeve and ring, respectively. Thus, the plug signal is effectively reversed between the left and right hand positions. In most applications this will not make any difference. However, if desired, the plug insertion from the left and right sides can be detected and electronic circuitry can reverse the signal output from the tuner, appropriately.

Another type of plug is a so-called shielded or balanced plug. A balanced plug has three contacts, namely tip, ring and sleeve. The ring contact is a small band between the tip and sleeve. Such a plug can be accommodated similarly to the arrangement for the two-conductor, unbalanced, plug shown in the FIGS. by adding an extra contact (or two) to connect to the ring of the plug.

Note that the design of the tuner in FIGS. 4A and 4B assumes that the horizontal dimension of the tuner is commensurate with the length of an inserted plug. If the tuner is a different dimension then the contacts can be handled in a different manner.

Figure 4C:
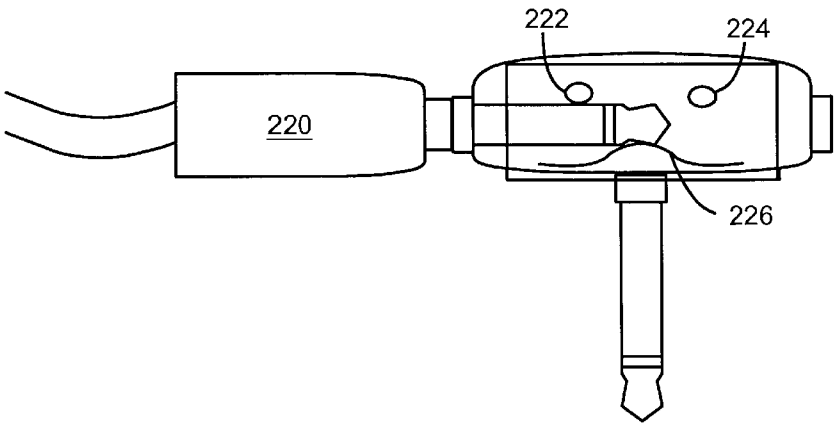
FIG. 4C shows a longer symmetrical device with a plug inserted into the left side.

FIG. 4C shows a tuner with a body that is horizontally substantially longer than a plug's length. In FIG. 4C, the sleeve of plug 220 is contacted by contact 222, as with FIG. 4A. However, the tip is contacted by contact 226 which now provides a signal path for the tuner to output to an external device via plug 220. The right-handed case, where the plug is inserted from the right side, will have a similar arrangement with contact 224 conducting to the sleeve while contact 226 still conducts to the tip. Note that with the design of FIG. 4C, the polarity of signal output is the same for both left and right positions.

Figure 6A:
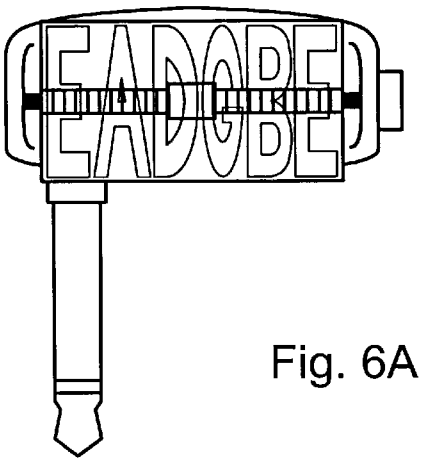
FIG. 6A is a right-handed device.
Figure 6B:
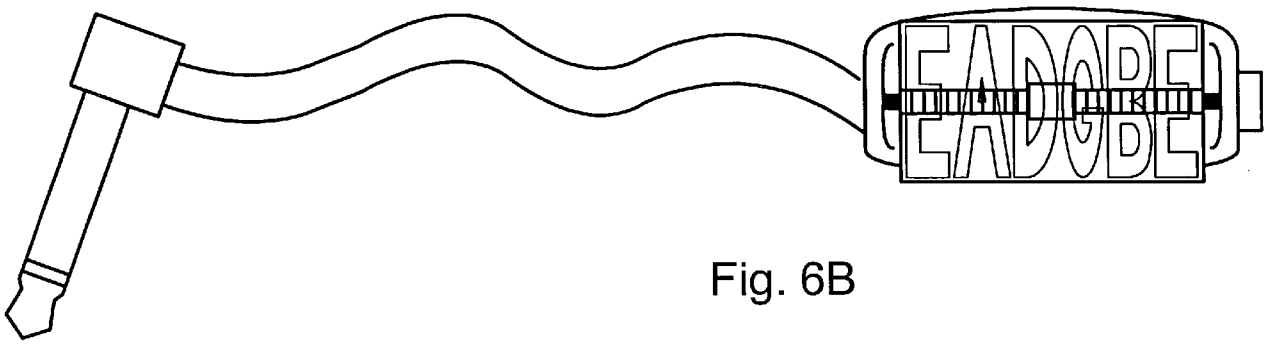
FIG. 6B is a device including a short length of attached cable.

Many different types of design are possible. Two alternative styles are shown in FIGS. 6A and 6B. In FIG. 6A, the tuner is designed for use with right-hand guitars, only. In FIG. 6B, the tuner is provided with a short length of cable that terminates in an angled plug.

One feature of the present invention is the ability to configure the display and operation. In FIG. 1A, display 104 includes six letters designating strings on a guitar.

The arrangement of six letters, "E," "A," "D," "G," "B," "E" from left-to-right across the display makes up a coarse tuning indicator. When a string is plucked on the guitar, the letter corresponding to the nearest pitch of the plucked string lights up. The horizontal meter bar across the center of the display then indicates the level of fine tuning, or "off pitch" amount of the string from the pitch indicated by the lighted letter of the coarse tuning indicator. In operation, the letters are outlined, shaded, or not as bright when they are not active. A letter becomes filled in, or brighter, when it is used to indicate a nearest note being played.

The EADGBE arrangement is standard for a six string guitar. That is, those are the six notes that are most commonly tuned on a standard guitar. The use of dedicated indicators for each of the six strings makes it easier for a musician to correlate the string with the desired note. If the string is very far out of tune then the wrong (i.e., non-corresponding) letter will light. Since the display is configured specially for a six string guitar having standard tuning the coarse mode indicators (i.e., the letters) can take up substantially all of the display area so that they are more readable. Since each letter indicator also is spatially separated from the other letters, and corresponds with the string layout of the guitar in relative positional placement (i.e., D follows A which follows B, etc.) it is also easier for a musician to make a visual connection between the indicators and strings.

A preferred embodiment of the invention allows a user to configure the tuner for different types of instruments such as a guitar, bass guitar, banjo, violin, etc. The tuner can also be configured to different tunings and numbers of strings on instruments.

Figure 5A:
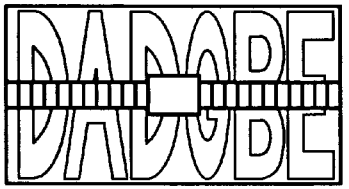
FIG. 5A is a first display configuration.

FIG. 5A shows the display of tuner 100 in a "drop-D" tuning for a guitar. In drop-D tuning, the low E of a guitar is tuned a whole step down to a D. This is reflected in the DADGBE coarse tuning indicators that now occupy the space of the EADGBE standard coarse tuning indicators of FIG. 1A.

Figure 5B:
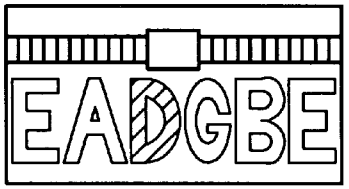
FIG. 5B is a first display configuration.

FIG. 5B shows standard tuning coarse indicator 504 adjacent to fine tuning indicator 402. This is a different layout from the overlapping fine and coarse tuning indicators of FIGS. 1A and 5A. In general, any arrangement or layout of indicators is possible including overlapping, adjoining, alternating, etc. The type of coarse and fine tuning indicators can be different from those shown in this application. For example, circles, lighted areas, symbols, etc., can be used in place of, or in addition to, letters in the coarse tuning indicator. A horizontal meter bar need not be used for the fine tuning indicator as a mechanical needle movement can be portrayed, a vertical meter bar can be used, etc. Any manner of indicator is acceptable.

In FIG. 5B, the letter D is shown shaded to illustrate that a string on the guitar closest to the note represented by D has been plucked. Light 506 on the fine tuning indicator is lit to show that the D string is slightly flat, or lower in pitch than the desired frequency corresponding with a D note.

Figure 5C:
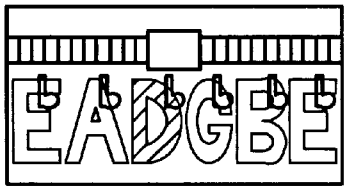
FIG. 5C is a first display configuration.

FIG. 5C illustrates the tuner in a configuration for a guitar tuned a half-step down. In FIG. 5C, the "flatted" symbol, "b", has been superimposed on each of the note letters. Similarly, a sharp symbol, "#", can be used to indicate notes that are a half-step above notes corresponding to the letters.

Figure 5D:
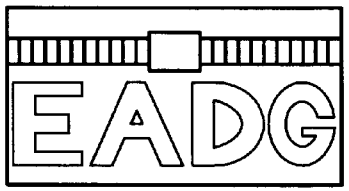
FIG. 5D is a first display configuration.

FIG. 5D illustrates letters for a coarse tuning of a standard bass guitar. Note that only four notes are shown -that correspond to the four standard-tuned strings on a bass guitar. The four letters can each be made larger than the six letters of configurations in 5B and 5C.

Figure 5E:
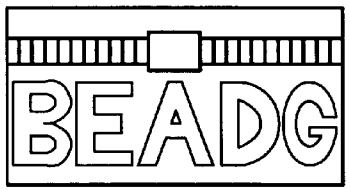
FIG. 5E is a first display configuration.

FIG. 5E illustrates a five-string bass guitar configuration where a low B string exists on the bass guitar. In each of the displays 1A and 5A–5E, the coarse tuning indicator letters maintain a one-to-one, spatial and letter relationship to each of the strings on the instrument. By using the user control buttons, as described below, different types of customized configurations can be achieved with the same device after the point of sale. Thus, the invention provides a flexible way to adapt a single device to many different tuning applications.

Figure 5F:
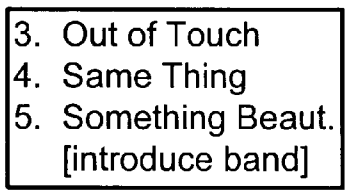
FIG. 5F is a first display configuration.
Figure 5G:
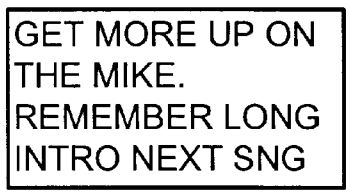
FIG. 5G is a first display configuration.
Figure 5H:
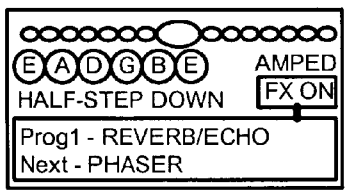
FIG. 5H is a first display configuration.

FIGS. 5F–H show the display of the tuner being used for purposes other than tuning. In FIG. 5F, song titles are displayed on the display screen. A number and title indicates to the musician the next song to be played. Additional notes such as the text "[introduce band]" can be included. The musician can scroll up or down through the list by using buttons such as 112 and 116 of FIG. 1A. Button 114 is used to switch the tuner from a tuning mode display configuration (e.g., as in FIG. 1A) to a setlist display configuration as shown in FIG. 5F.

FIG. 5G illustrates a text message mode display configuration. In FIG. 5G, the tuner displays text messages. The text messages can be sent through hard wire, infrared, radio frequency, etc. A cable plugged into one of the jacks of the tuner, such as 106 or 108 in FIG. 1A, can be used to convey text message signals. Or an additional communication link can be provided via a connector such as connector 134. In a preferred embodiment, a wireless messaging device such as a cell phone, Blackberry™, personal digital assistant (PDA), personal computer (PC), etc., can be used to send a message to the display. Such messages can be used to give useful information to a musician during a performance such as the example messages to "get more up on the microphone" or "remember long intro to the next song." Other applications for text display are possible.

FIG. 5H shows a composite display configuration. In FIG. 5H, the display conveys several types of information. A coarse tuning indicator is shown at 516 and 518. A fine tuning indicator is shown at 510. An indication that the signal from the tuner is going to a live amp is shown by display of the word "AMPED" at 512. A similar type of message can be used to indicate that the signal from the instrument is being recorded, is being broadcast, etc. The boxes at 514 tell the musician that guitar effects are active and that the effects are reverberation and echo effects. There is also an indication that the next effect to be selected (e.g., by stepping on a footswitch) is going to be a phaser effect. In general, any type of text or other image information can be displayed.

A preferred embodiment of the invention allows the display to be configured using buttons 112, 114 and 116, shown in FIGS. 1A–C. By using combinations, sequences, intervals, duration, etc. of button presses, the user can select, e.g., notes for coarse tuning indicators, type or style of fine tuning indicators, text or other types of indicators, position of indicators, etc. The device can also receive configuration information from another device, such as a PC, by connecting via the universal serial bus (USB) connector 134 of FIG. 1C. Any type of communication link can be used to receive configuration information such as IEEE 1334 (Firewire), 802.11 wireless, Ethernet, etc.

An advantage in obtaining configuration information from external sources is that a more efficient user interface can be used to allow detailed design and customization of display configurations. Also, updates to the display and function of the tuner can be obtained. For example, operating system or other software can be loaded into the tuner after the point of sale. The tuner can also function as an analog to digital (A/D) converter to convert a signal from the guitar to a sequence of digital data. The digital data can be sent over a wire, optical cable or other physical medium, or via radio frequency, infrared or other wireless mechanisms.

Although the invention has been described with respect to specific embodiments thereof, these embodiment are illustrative, and not restrictive, of the invention.

For example, although specific body styles and sizes have been illustrated, the invention can use any suitable size and shape for its body, or housing.

What is claimed is:

1. A musical instrument tuner comprising a display screen; and at least one configuration control for configuring the display screen in first and second display configurations wherein a first note indicator corresponding to a first musical note is in a first position in the first display configuration, and wherein the first note indicator is in a position different from the first position in the second display configuration.

2. The apparatus of claim 1, wherein the first display configuration includes a display representing a first number of strings of a musical instrument, and wherein the second display configuration includes a display representing a second number of strings, wherein the first and second numbers of strings are different.

3. The apparatus of claim 1, wherein the first display configuration includes a display of a first set of notes, and wherein the second display configuration includes a display of a second set of notes, wherein the first and second sets are not the same.

4. The musical instrument tuner of claim 1, wherein the first note indicator is not present in the second display configuration.

5. A musical instrument tuner comprising a display screen;

at least one configuration control for configuring the display screen in first and second display configurations;

a plug for electrically coupling the musical instrument tuner to an instrument and for mounting the tuner adjacent to the instrument.

6. A musical instrument tuner comprising a display screen;

at least one configuration control for configuring the display screen in first and second display configurations;

a plurality of instrument presets for selectively configuring the display screen for different instruments.

7. A musical instrument tuner comprising a display screen;

at least one configuration control for configuring the display screen in first and second display configurations;

a selection mode for accepting user input to select one or more frequencies as a target tuning frequency;

a display control for indicating at least one of the target tuning frequencies on the display screen during a tuning operation.

8. A musical instrument tuner comprising a display screen;

least one configuration control for configuring the display screen in first and second display configurations;

a communication coupling between the musical instrument tuner and an external device; and a configuration process for receiving a communication from the external device to define a configuration of the display screen.

9. The musical instrument tuner of claim 8, wherein the communication coupling includes a connector for coupling of the musical instrument tuner to a digital network.

10. The musical instrument tuner of claim 8, wherein the communication coupling includes a coupling of the musical instrument tuner to a digital network via a wireless connection.

11. A musical instrument tuner comprising a body for housing an indicator that indicates a degree of tuning of a musical instrument;

a plug integral with the tuner for mounting the tuner adjacent to the musical instrument and for receiving an output from the musical instrument; and first and second jacks for receiving plugs so that the tuner is operable symmetrically in a left or right hand configuration.

12. The musical instrument tuner of claim 11, further comprising a display screen coupled to the body;

at least one configuration control for placing the musical instrument tuner in first and second display configurations.

13. The musical instrument tuner of claim 12, wherein the first display configuration includes a coarse mode display for an instrument with a first number of strings, and wherein the second display configuration includes a coarse mode display for an instrument with a second number of strings, wherein the first and second numbers of strings are different.

14. The musical instrument tuner of claim 12, wherein the first display configuration includes a coarse mode display of a first set of notes, and wherein the second display configuration includes a coarse mode display of a second set of notes, wherein the first and second sets are not the same.

15. An instrument display comprising a display screen;

mounting means for mounting the display screen proximate to a musical instrument;

a control system for receiving signals; and a display system for deriving text information from the received signals and for displaying the visual information on the display screen.

16. The instrument display of claim 15, further comprising one or more user input controls for allowing a user to enter the signals.

17. The instrument display of claim 15, further comprising a coupling to an external device for receiving the signals.

18. The instrument display of claim 15, wherein the signals indicate one or more effects applied to a signal generated by a musical instrument.

19. The instrument display of claim 15, wherein the signals indicate lyrics.

20. The instrument display of claim 15, wherein the signals indicate songs.

21. The instrument display of claim 15, wherein the signals indicate music.

22. A musical instrument tuner comprising a display screen; and at least one configuration control for configuring the display screen in first and second display configurations wherein a first note indicator corresponding to a first musical note is of a first shape in the first display configuration, and wherein the first note indicator is of a second shape, different from the first shape, in the second display configuration.

23. The musical instrument tuner of claim 22, wherein the first shape includes a first symbol and wherein the second shape includes a second symbol.

24. The musical instrument tuner of claim 23, wherein the first symbol includes a first text character and wherein the second symbol includes a second text character.

25. The musical instrument tuner of claim 22, wherein the first shape includes a first size and wherein the second shape includes a second size.

* * * * *